US005611573A

United States Patent [19]

Lobel et al.

[11] Patent Number: 5,611,573

[45] Date of Patent: Mar. 18, 1997

[54] RETRACTOR FOR BINDERS AND METHOD OF USE

[76] Inventors: Frederick B. Lobel, 13080 Mindanao Way, #78, Marina del Rey, Calif. 90292; Alexander Dolmatsky, 11333 Dona Pegita Dr., Studio City, Calif. 91609

[21] Appl. No.: 496,949

[22] Filed: Jun. 30, 1995

[51] Int. Cl.[6] ..... B42D 3/18

[52] U.S. Cl. ..... 281/29; 281/36; 281/37; 402/70; D19/27; D19/32

[58] Field of Search ..... 281/29, 31, 33, 281/45, 36, 51, 37; 402/80 R, 73, 75, 4, 76, 502, 70; 150/143; 190/901, 903; 206/472, 810; D3/252, 285, 301, 289; D6/632; D19/26, 27, 32; 24/405, 432

[56] References Cited

U.S. PATENT DOCUMENTS

| | | | |
|---|---|---|---|
| 2,079,817 | 5/1937 | Schade et al. | 402/70 |
| 2,115,993 | 5/1938 | Kranhold | 281/29 |
| 2,173,120 | 9/1939 | Lifton | 281/31 X |
| 2,190,090 | 2/1940 | Tharp | 281/33 |
| 2,240,122 | 4/1941 | Schade | 281/33 |
| 2,252,783 | 8/1941 | Potts et al. | 402/70 |
| 2,478,083 | 8/1949 | Broughton | 150/143 |
| 2,502,275 | 3/1950 | Perlin | 402/70 |
| 2,520,250 | 8/1950 | Meyers | 190/26 |
| 2,554,215 | 5/1951 | Schell et al. | 190/115 |
| 2,581,763 | 1/1952 | Hickler | 190/119 |
| 2,623,566 | 12/1952 | Kibler | 190/901 X |
| 2,755,837 | 7/1956 | Kosek | 190/901 X |
| 2,778,397 | 1/1957 | Carrasco | 190/119 |
| 3,023,794 | 3/1962 | Lifton | 190/102 |
| 5,489,021 | 2/1996 | Wallingford | 206/214 |

*Primary Examiner*—Frances Han
*Attorney, Agent, or Firm*—Timothy T. Tyson; Ted Masters

[57] ABSTRACT

A retractor (50), for a binder (20) having two covers (22, 24) foldably connected by a spine (26) and selectively closable by a split gusset (28) carrying a slide fastener (34) and having an extending portion (36), includes an elastic member (52) having one end (54) connected to the extending portion and the opposite end (56) fixedly positioned along the spine. As the covers are closed, the extending portion is drawn inwardly along the spine, and as the covers are opened the extending portion moves stretchably outwardly along the spine.

11 Claims, 7 Drawing Sheets

FIG. 9
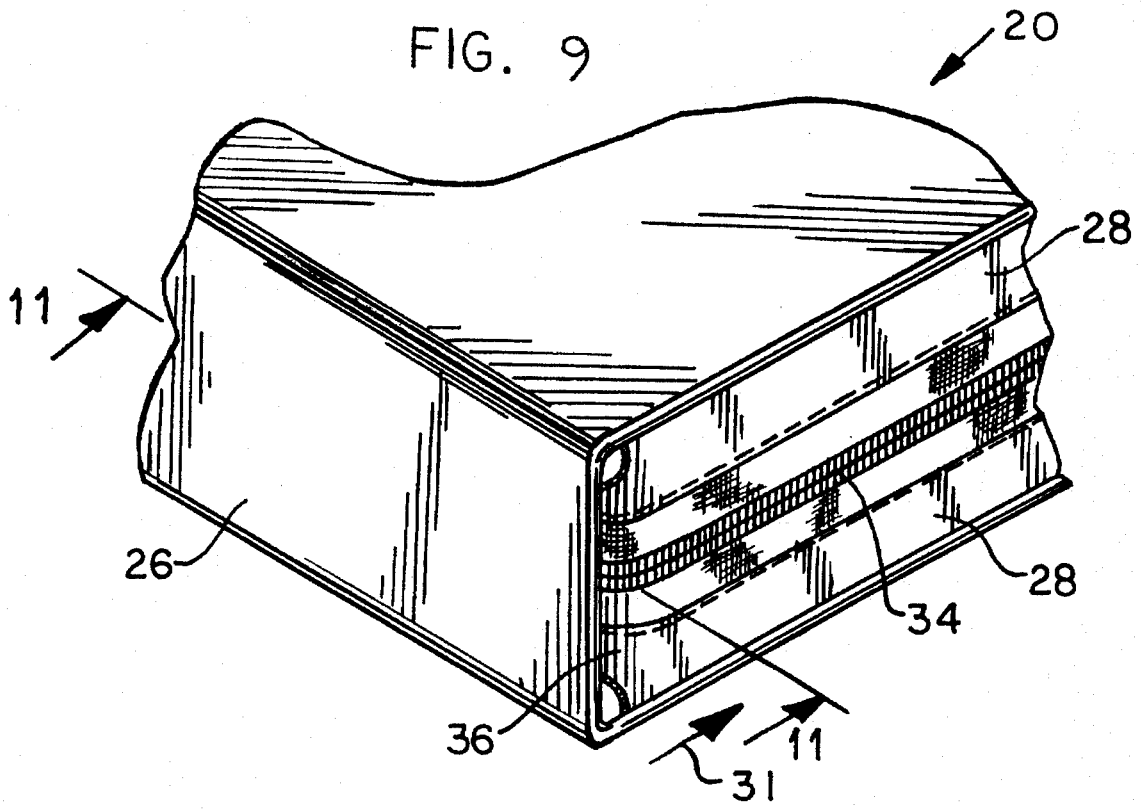
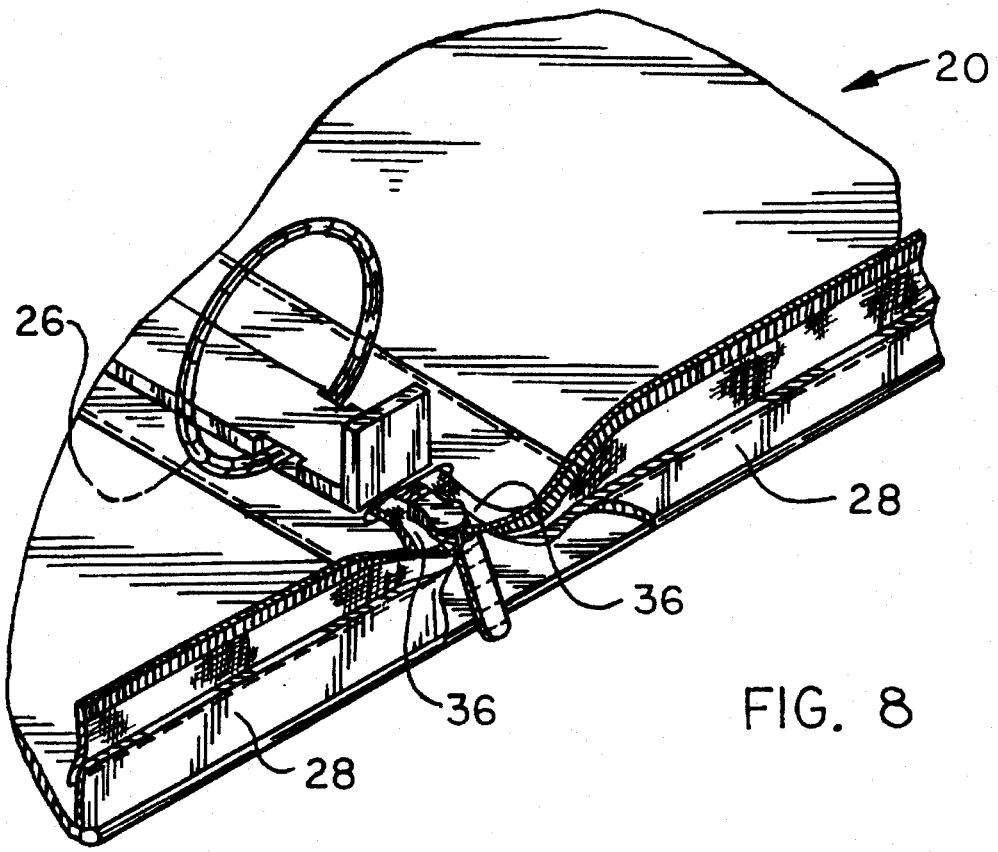
FIG. 8

RETRACTOR FOR BINDERS AND METHOD OF USE

TECHNICAL FIELD

The present invention pertains to binders having two covers foldably connected by a spine and selectively closable by a split gusset carrying a slide fastener and having an extending portion, and more particularly to an improved binder and method comprising an elastic retractor for retractably drawing the extending portion of the gusset inwardly along the spine as the binder is closed.

BACKGROUND ART

Closable binding devices for holding papers or other items have been known in the art for many years. These devices generally consist of two cover members foldably connected by a spine member, and a gusset split by a slide fastener such as a zipper connected around the edges of the cover members. For example, U.S. Pat. No. 2,079,817 shows a loose leaf book of the ring binder type wherein the edges of the covers are locked together. A zipper is utilized to effect the locking. U.S. Pat. No. 2,115,993 describes a brief case book whose sides lies flat when the case is wide open. The sides may be secured by a flexible locking means. U.S. Pat. No. 2,173,120 discloses a brief case or correspondent's portfolio having front and rear panels spaced apart by a split and flexible gusset carrying a locking means. The brief case has reinforced marginal portions to sustain the complementary section in a desired shape. U.S. Pat. No. 2,252,783 defines a loose leaf binder having a sheet retaining mechanism adapted to carry a substantial bulk of material such as catalogs. The binder lies flat when the case is opened. U.S. Pat. No. 2,502,275 depicts an improved brief case adapted to interchangeably receive and detachably retain a carrier means for a loose leaf binder. Snap fasteners are employed to secure the binder. U.S. Pat. No. 2,520,250 constitutes a luggage cover having side and end walls laterally stretchable and longitudinally yieldable. The luggage cover is designed to fit over and protect the surface of the luggage. The cover is elastically expansible to conform with the contour of the article and may be easily and quickly removed for cleaning. U.S. Pat. No. 2,554,215 consists of a flat opening case in which the handle may be attached to the fold line of the case. The case has a slide fastener closer for the opposite sides. U.S. Pat. No. 2,581,763 portrays a brief case and method of making same. The edges, normally subject to fraying and abrasion, present a continuous unbroken surface of uniform resistance. U.S. Pat. No. 2,623,566 shows a traveling case for toilet articles. The case is designed for carrying compactly, in a small space, in separated, well protected, and readily accessible arrangement, a multiplicity of miniature toilet articles. U.S. Pat. No. 2,755,837 describes brief cases of the type that are folded double when closed and are laid out flat when open. The brief case is especially suited to the transport of the personal records of military personnel, and has a transparent panel on one side for inserting an identification card from inside the case. U.S. Pat. No. 2,778,397 discloses a cover for a loose leaf notebook or the like having a zipper means for closing the notebook. The cover lies flat when open by virtue of a slide fastener having a novel extending portion. The extending portion is especially designed for use with large metal ring binders. U.S. Pat. No. 3,023,794 depicts a combination brief case and writing board, in which the writing board may be readily placed out of the way without interference with the papers or other objects that are carried within the case.

U.S. Pat. No. 2,778,397 cited above is of particular significance in that this invention is directed toward ring binders that can accommodate metal rings and can also lie flat when opened. As disclosed in the patent, this desirable combination of features is achieved by adding an extending portion to the split gusset which is not joined to the covers. The extending portion serves as a stress relief which permits the gusset to be fully opened so that the binder will lie flat on a desk or other surface. However, while the extending portion of the gusset does indeed permit the binder to lie flat on a desk or other flat surface, the extending portion also dangles out and thereby both gives the binder a ragged appearance, and creates a potential for inadvertent snagging. To avoid this, a pocket is sometimes provided which receives the end of the extending portion.

The present invention improves on this extending portion gusset concept by providing a retractor which automatically draws the extending portion inwardly along the spine of the binder as the binder is closed. In so doing the binder always has a neat and trim appearance.

DISCLOSURE OF INVENTION

The present invention is directed to an improved binder and method wherein a retractor including an elastic member retractably draws the extending portion of the binder's split gusset inwardly along the spine member as the binder cover is closed, and stretchably allows the extending portion to move outwardly along the spine member as the binder is opened. When the binder is fully opened the elastic member stretches so as to allow both covers of the binder to lie flat on a flat surface.

In accordance with a preferred embodiment of the invention, the retractor includes an elastic member having one end connected to the extending portion of the split gusset, and the other end fixedly positioned along the spine of the binder.

In accordance with an important aspect of the invention the elastic member includes a ribbon fabricated from elastic material.

In accordance with an important feature of the invention the binder includes a slot oriented perpendicular to the spine member, the extending portion passing through the slot and connecting to the retractor.

In accordance with another important aspect of the invention, the retractor continuously urges the extending portion inwardly along the spine member so as to give the binder a trim appearance.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 8 is a fragmented perspective view of the improved binder in the open position;

FIG. 9 is a fragmented perspective view of the improved binder in the closed position;

MODES FOR CARRYING OUT THE INVENTION

Figure 1:
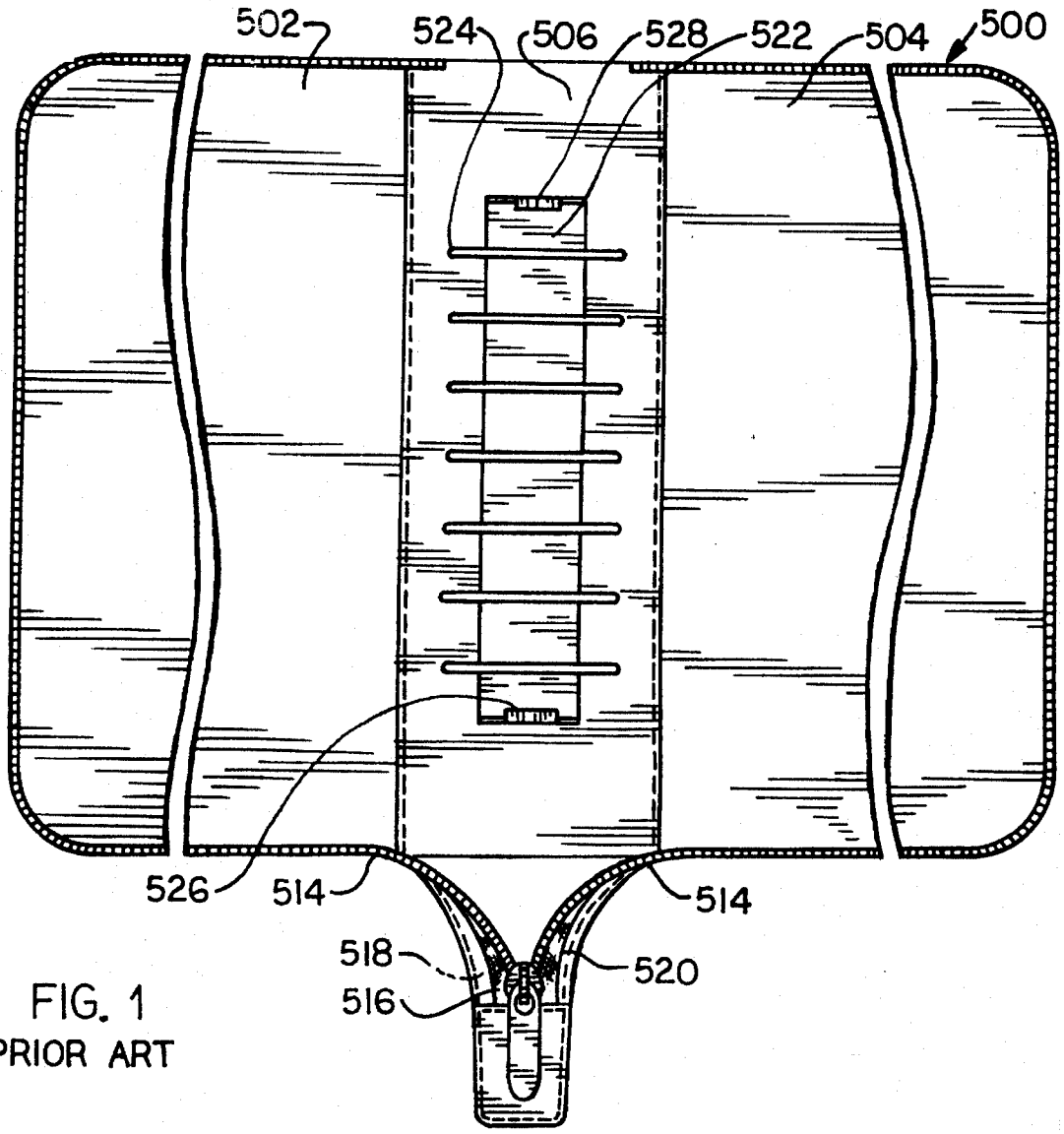
FIG. 1 PRIOR ART
FIG. 1 is a fragmented plan view of a prior art binder shown in the open position.
Figure 2:
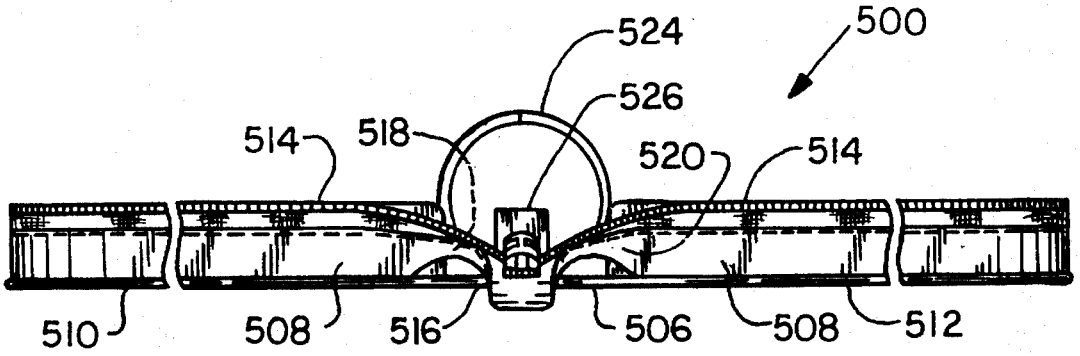
FIG. 2 PRIOR ART
FIG. 2 is a fragmented end view of the prior art binder of FIG. 1.

Referring initially to FIGS. 1 and 2, there are illustrated fragmented plan and fragmented end views of a prior art binder shown in the open position, generally designated as 500. The binder 500 has two cover members 502 and 504 foldably connected by spine member 506. Split gusset 508 is connected around edges 510 and 512 of cover members 502 and 504 and carries slide fastener 514. In the embodiment shown the slide fastener is a conventional zipper. Split gusset 508 has extending portion 516 which is not joined to cover members 502 and 504 and has first side 518 and opposite second side 520. Ring mounting member 522 has a plurality of ring sections 524 which are openable through the action of opening levers 526 and 528. Ring mounting member 522 is fixedly attached to spine member 506 by rivets or other appropriate mounting means.

For ring sections 524 having a diameter of 1 or 1½ inches, an extending portion 516 is not necessary since the width of the gusset 508 is not sufficient to cause stress upon opening, and the binder covers 502 and 504 will both lie flat upon a desk or other surface. However, for binders 500 having 2 inch or larger ring sections 524, the gusset 508 is stressed upon opening and covers 502 and 504 will not both lie flat. It is the later case to which the extending portion design is directed. Extending portion 516 of split gusset 508 serves as a stress relief which avoids gusset 508 stress and allows the binder 500 to lie flat when fully opened as is shown in FIG. 2.

Figure 3:
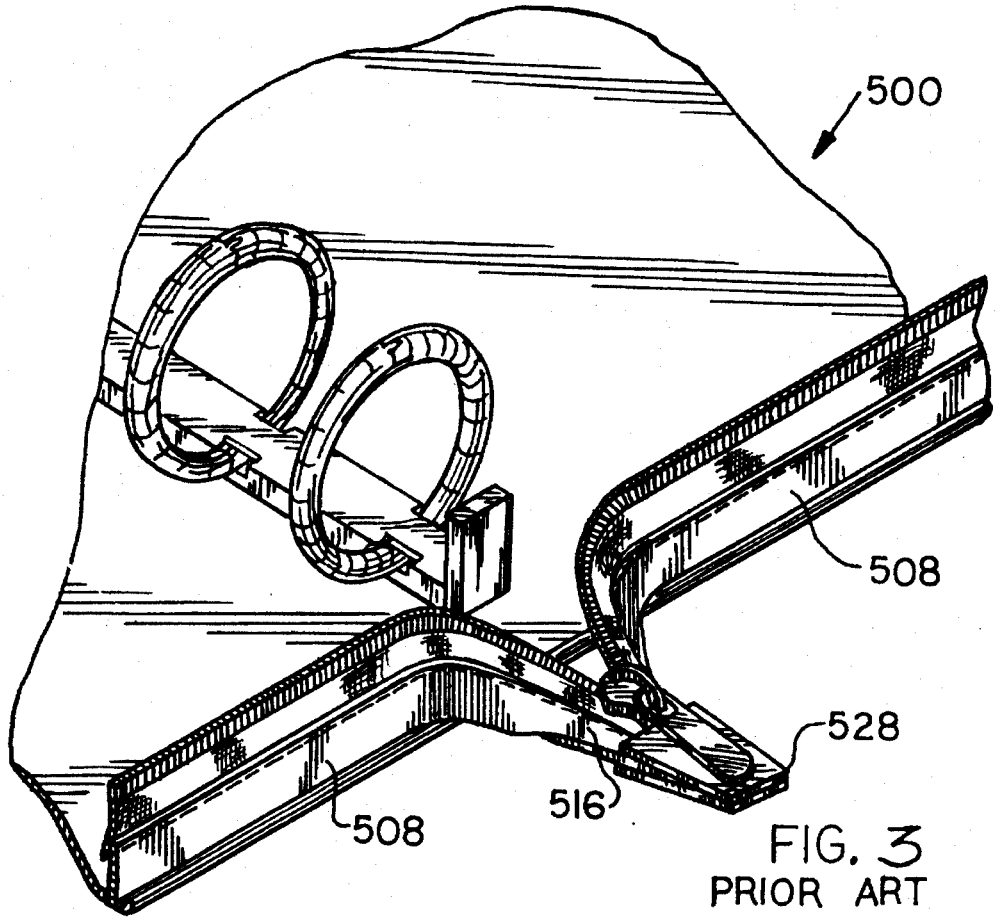
FIG. 3 PRIOR ART
FIG. 3 is a fragmented perspective view of the prior art binder in the open position showing the extending portion of the split gusset.

FIG. 3 is a fragmented perspective view of the prior art binder 500 in the open position showing extending portion 516 of split gusset 508. The two ends of extending portion 516 are connected to tab 528.

Figure 4:
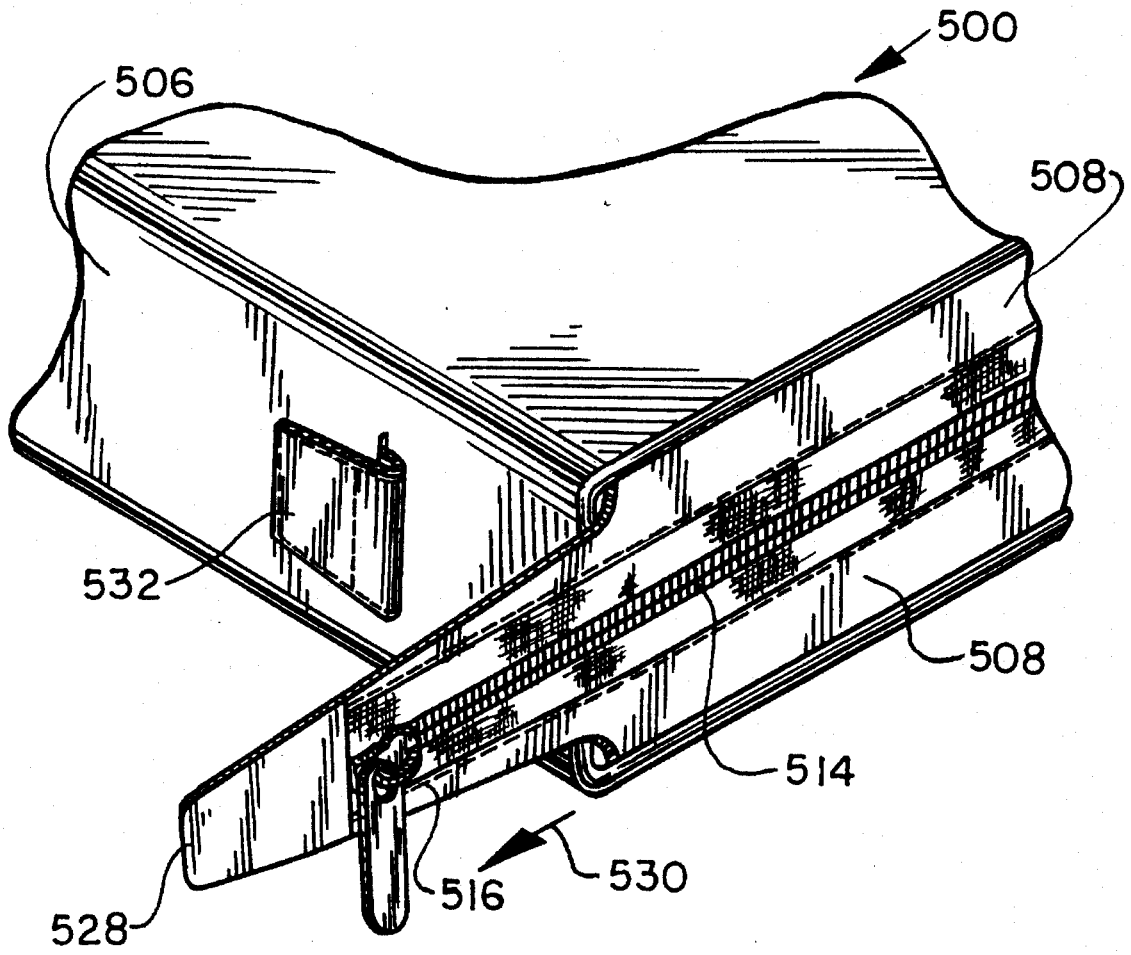
FIG. 4 PRIOR ART
FIG. 4 is a fragmented perspective view of the prior art binder in the closed position showing the extending portion of the split gusset.

FIG. 4 is a fragmented perspective view of the prior art binder 500 in the closed position showing extending portion 516 of split gusset 508. Slide fastener 514 has been fully closed in direction 530. Pocket 532 is attached to spine member and is sized to accept tab 528.

Figure 5:
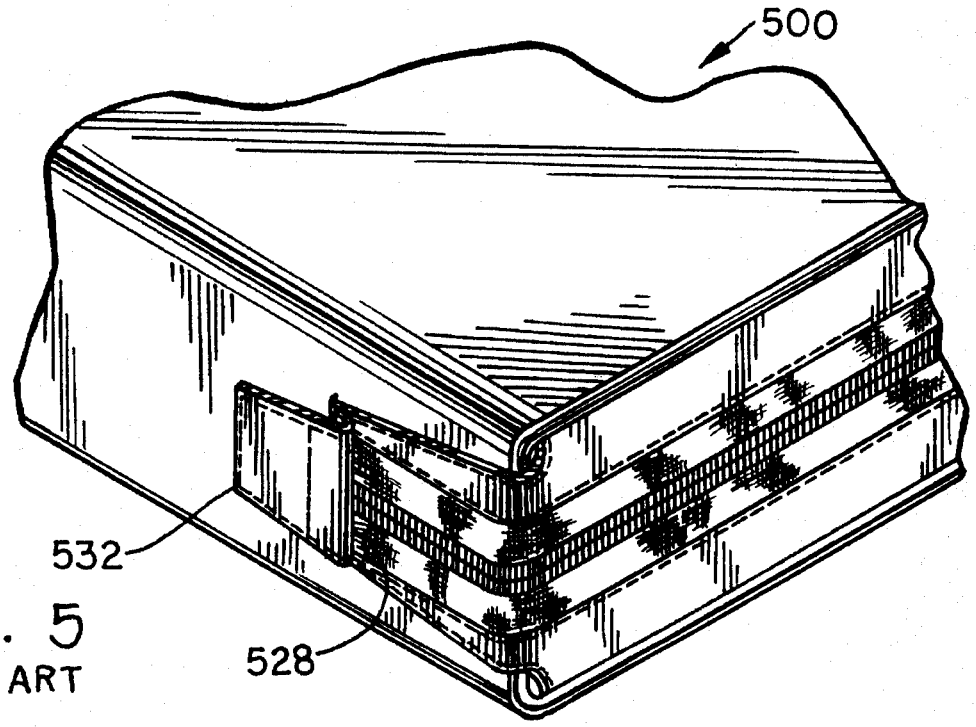
FIG. 5 PRIOR ART
FIG. 5 is a fragmented perspective view of the prior art binder in the closed position showing the extending portion tucked into a pocket on the spine.

FIG. 5 is a fragmented perspective view of the prior art binder 500 in the closed position showing tab 528 tucked into pocket 532 thereby giving the binder 500 a more trim appearance.

Figure 6:
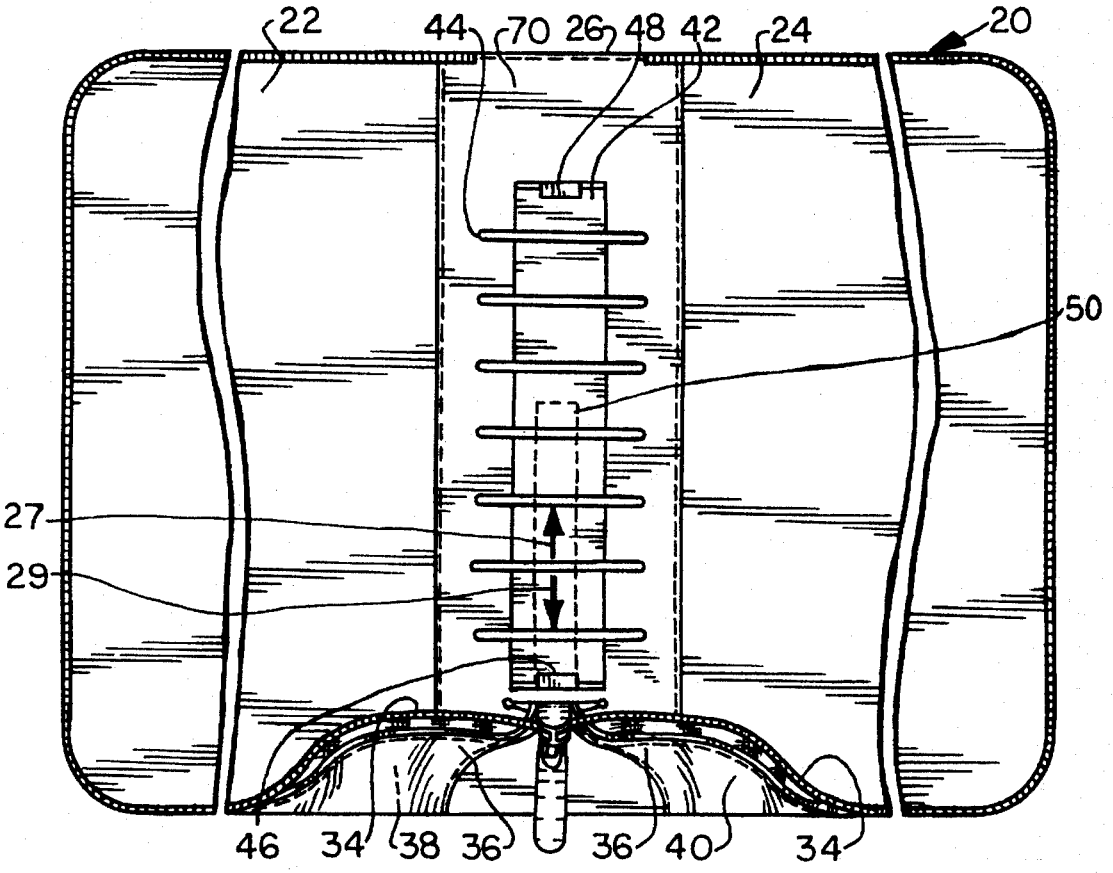
FIG. 6 is a fragmented plan view of an improved binder in the open position in accordance with the present invention.
Figure 7:
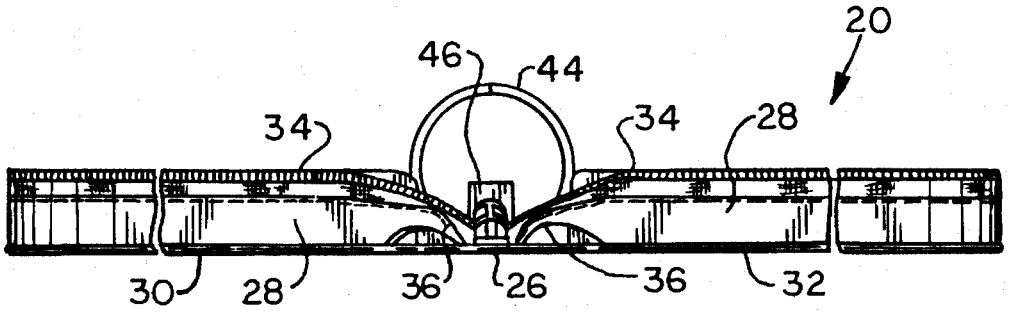
FIG. 7 is a fragmented end view of the improved binder of FIG. 6.
Figure 10:
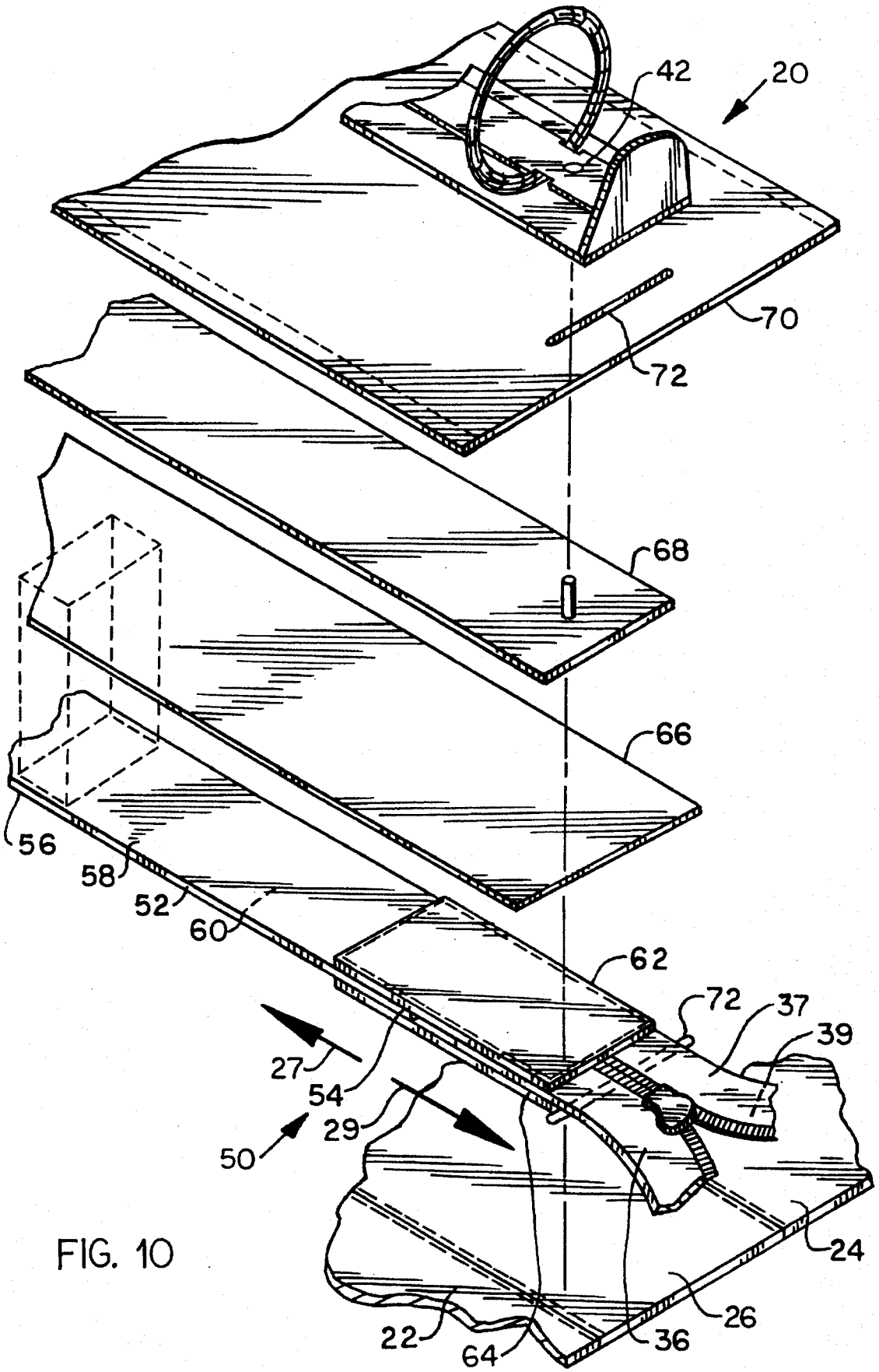
FIG. 10 is a fragmented exploded view of the improved binder showing the retractor.
Figure 11:
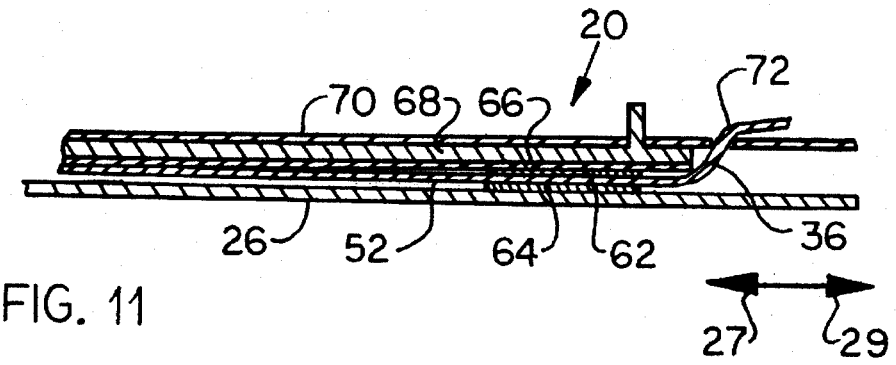
FIG. 11 is a fragmented cross sectional view along the line 11—11 of FIG. 9; and, FIG. 12 is a fragmented perspective view of the retractor.
Figure 12:
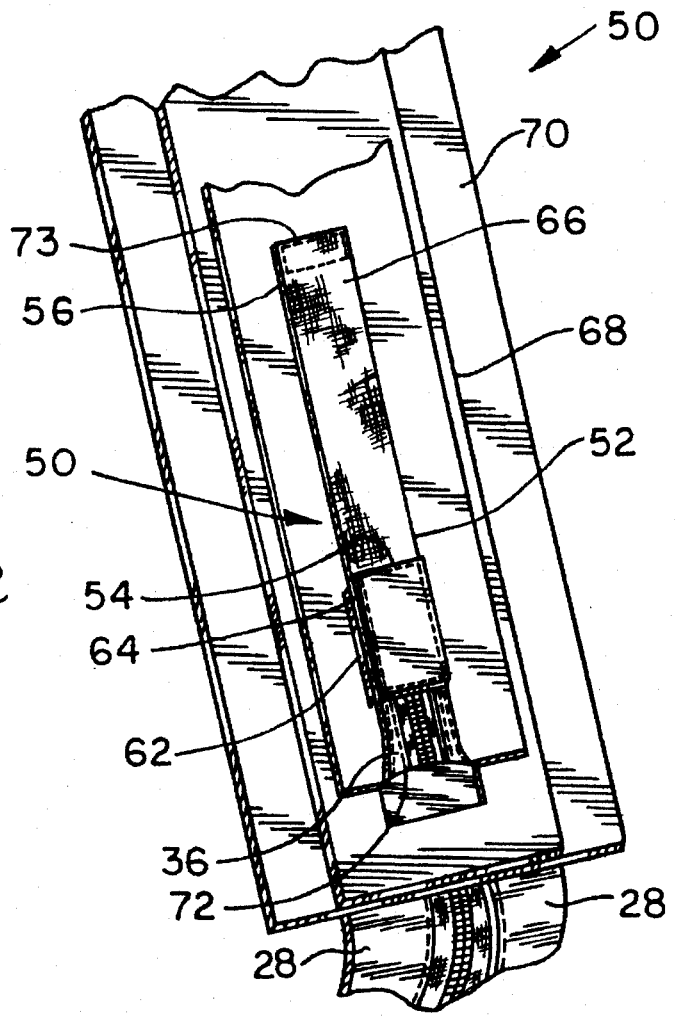

Now referring to FIGS. 6 and 7, there are illustrated fragmented plan and fragmented end views of an improved binder in accordance with the present invention shown in the open position, generally designated as 20. The improvement resides in the retractor 50 as is illustrated in FIGS. 10, 11, and 12. Similar to prior art binder 500 of FIGS. 1 and 2, binder 20 has two cover members 22 and 24 foldably connected by spine member 26. Split gusset 28 is connected around edges 30 and 32 of cover members 22 and 24 and carries slide fastener 34. In the embodiment shown, the slide fastener 34 is a conventional zipper. Split gusset 28 has extending portion 36 which is not joined to cover members 22 and 24 and has first side 38 and opposite second side 40. Ring mounting member 42 has a plurality of ring sections 44 which are openable through the action of opening levers 46 and 48. Ring mounting member 42 is fixedly attached to spine member 26 by rivets or other appropriate mounting means. Extending portion 36 is connected to an elastic retractor 50 located along spine member 26 (refer also to FIG. 10) so that extending portion 36 is retractably drawn inwardly along spine member 26 in direction 27 as binder 20 is closed, and stretchably moves outwardly along spine member 26 in direction 29 as binder 20 is opened.

FIG. 8 is a fragmented perspective view of improved binder 20 in the open position showing extending portion 36 of split gusset 28 stretchably moved outwardly along spine member 26. It is noted that the extending portion 36 does not dangle out, but is rather located along spine member 26 thereby giving binder 20 a trim appearance.

FIG. 9 is a fragmented perspective view of improved binder 20 in the closed position showing extending portion 26 of split gusset 28 retractably drawn inwardly along spine member 26 thereby also giving binder 20 a trim appearance. Slide fastener 34 has been closed in direction 31.

FIG. 10 is a fragmented exploded view of improved binder 20 showing the retractor 50 and its relationship to the other elements of binder 20. Retractor 50 is comprised of elastic member (ribbon) 52 having first end 54 and second opposite end 56, first and second connector strips 62 and 64, planar member 66, and slot 72. In the embodiment shown, the elastic member includes a ribbon 52 fabricated from an elastic material, such as a rubber impregnated fabric, having a first side 58 and an opposite second side 60. It is noted that the elastic member could assume any one of a variety of shapes, sizes, and compositions so long as it is resiliently stretchable. First end 54 is connected to extending portion 36 of split gusset 28 (refer to FIG. 8). Second end 56 is fixedly positioned along spine member 26. First connector strip 62 connects first side 37 of extending portion 36 to first side 58 of ribbon 52. Second connector strip 64 connects second side 39 of extending portion 36 to second side 60 of ribbon 52. In the embodiment shown the connection is effected by stitching first and second connector strips 62 and 64 to extending portion 36 and ribbon 52. Other attachment means such as glue, staples, rivets, or the like could also be utilized. Through the elastic action of ribbon 52, extending portion 36 moves in direction 27 as binder 20 is closed, and in direction 29 as binder 20 is opened. A substantially planar member 66 is connected to first side 58 of first end 56 of ribbon 52. In the embodiment shown, the connection is effected by stitching, however, as mentioned above, other means are also possible. Planar member 66 is fixedly positioned along spine member 26 through the attachment of ring plate 68 and innerlining 70 which is stitched to spine member 26. Slot 72 in innerlining 70 is oriented perpendicular to spine member 26, and is sized to accept the extending portion 36 which passes therethrough for connection to retractor 50.

FIG. 11 is a fragmented cross sectional view along the line 11—11 of FIG. 9. Elastic ribbon 52 is connected to extending portion 36 by first strip 62 and second strip 64. Elastic ribbon 52 is connected to substantially planar member 66 which is held in place by ring plate 68 and innerlining 70 which is stitched to spine member 26. Extending portion 36 passes through slot 72 in innerlining 70 and resiliently moves in direction 27 as binder 20 is closed and in direction 29 as binder 20 is opened.

FIG. 12 is a fragmented perspective view of retractor 50 showing its relationship to other elements of an unassembled binder. First end 54 of elastic ribbon 52 is connected to extending portion 36 of split gusset 28 by first and second connector strips 62 and 64. Extending portion 36 passes through slot 72 in innerlining 70. Second end 56 of elastic ribbon 52 is connected by stitching 73 to substantially planar member 66 which is fixedly held in position along spine member 26 (refer to FIG. 6) by ring plate 68 and innerlining 70.

The preferred embodiments of the invention described herein are exemplary and numerous modifications, procedural variations, rearrangements, and adjustments can be readily envisioned to achieve an equivalent result, all of which are intended to be embraced within the scope of the appended claims.

We claim:

1. A retractor for use in a binder having two cover members foldably connected by a spine member and having a split gusset carrying a slide fastener, the split gusset having an extending portion having a first side and an opposite second side, said retractor comprising:

an elastic member having a first end and an opposite second end, said first end connected to the extending portion, and said second end fixedly positioned along the spine member so that the extending portion is retractably drawn inwardly along the spine member as the binder is closed, and stretchably moves outwardly along the spine member as the binder is opened.

2. The retractor according to claim 1, wherein said elastic member includes a ribbon having a first side and an opposite second side, said ribbon fabricated from elastic material.

3. The retractor according to claim 2, further including:

a first connector strip connecting the first side of the extending portion and said first side of said ribbon; and, a second connector strip connecting the second side of the extending portion and said second side of said ribbon.

4. The retractor according to claim 3, wherein said first connector strip and said second connector strip are connected to the extending portion and said ribbon.

5. The retractor according to claim 2, further including a substantially planar member connected to said first side of said ribbon, said planar member fixedly positioned along the spine member of the binder.

6. The retractor according to claim 5, wherein said planar member is connected to said ribbon.

7. The retractor according to claim 1, the binder further including an interlining having a slot oriented perpendicular to the spine member, the extending portion passing through said slot.

8. The retractor according to claim 1, wherein when the binder is open said elastic member stretching so as to allow both covers of the binder to lie flat on a flat surface.

9. The retractor according to claim 1, further comprising:

an elastic member including a ribbon having a first side and an opposite second side, said ribbon fabricated from elastic material;

a first connector strip connecting the first side of the extending portion and said first side of said ribbon;

a second connector strip connecting the second side of the extending portion and said second side of said ribbon;

said first connector strip and said second connector strip connected to the extending portion and said ribbon; and, the binder further including an interlining having a slot oriented perpendicular to the spine, the extending portion passing through said slot.

10. An improved binder of the type having two cover members foldably connected by a spine member and having a split gusset carrying a slide fastener, the split gusset having an extending portion, wherein the improvement comprises:

a retractor including an elastic member having a first end and an opposite second end, said first end connected to the extending portion, and said second end fixedly positioned along the spine member so that the extending portion is retractably drawn inwardly along the spine member as the binder is closed, and stretchably moves outwardly along the spine member as the binder is opened.

11. A method for retracting the extending portion of the split gusset of a binder having two cover members and a spine member, comprising the steps of:

providing a retractor having an elastic member having a first end and an opposite second end;

connecting said first end to the extending portion;

fixedly positioning said second end along the spine member;

opening the cover members and observing that the extending portion moves outwardly along the spine member thereby permitting the cover members to lie flat on a flat surface; and, closing the cover members and observing that the extending portion is retractably drawn inwardly along the spine member.

* * * * *